US010161629B2

(12) United States Patent
Yang

(10) Patent No.: US 10,161,629 B2
(45) Date of Patent: Dec. 25, 2018

(54) GAS TORCH HEAD INCLUDING BURNER TUBE THEREOF BEING REPLACEABLE

(71) Applicant: Pro-Iroda Industries, Inc., Taichung (TW)

(72) Inventor: Cheng-Nan Yang, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 384 days.

(21) Appl. No.: 15/006,178

(22) Filed: Jan. 26, 2016

(65) Prior Publication Data

US 2016/0258620 A1 Sep. 8, 2016

(30) Foreign Application Priority Data

Mar. 5, 2015 (TW) ..... 104107002 A

(51) Int. Cl.
*F23D 14/38* (2006.01)
*F23D 14/00* (2006.01)

(52) U.S. Cl.
CPC ..... *F23D 14/38* (2013.01); *F23D 14/00* (2013.01)

(58) Field of Classification Search
CPC ..... F23D 14/28; F23Q 2/163; B23K 3/022
USPC ..... 219/137.63; 431/344, 353
See application file for complete search history.

(56) References Cited

U.S. PATENT DOCUMENTS 1,589,781 A * 6/1926 Anderson ..... E21B 17/046 285/330
2,008,232 A * 7/1935 Walker ..... F23D 14/38 285/332
2,465,643 A * 3/1949 Goss ..... F23D 14/28 239/337
2,666,480 A * 1/1954 Peterson ..... F23D 14/28 431/142
2,683,484 A * 7/1954 Falligant ..... F23D 14/28 126/38
3,196,924 A * 7/1965 Kaminga ..... F16K 31/58 222/3
3,623,753 A * 11/1971 Henry ..... E21B 17/043 285/330
3,741,251 A * 6/1973 Rees ..... F16F 9/38 138/96 R
3,994,674 A 11/1976 Baumann et al.
4,128,391 A * 12/1978 Braunstein ..... F17C 13/04 137/505.41
4,545,759 A 10/1985 Giles et al.
4,744,748 A * 5/1988 Raines ..... F23D 14/74 239/552

(Continued)

FOREIGN PATENT DOCUMENTS

CN 201463711 U 5/2010
CN 201534120 U 7/2010

(Continued)

*Primary Examiner* — Jorge Pereiro

(74) *Attorney, Agent, or Firm* — Alan D. Kamrath; Kamrath IP Lawfirm, P.A.

(57) ABSTRACT

A gas torch head includes a main body, a burner tube releasably inserted into the main body, and a retainer configured to secure the main body and the burner tube together selectively. The retainer is mounted on one of the main body and the burner tube and is movable between a first position engaging with the other of the main body and the burner tube and a second position disengaging from the other of the main body and the burner tube, respectively.

11 Claims, 12 Drawing Sheets

(56) References Cited

U.S. PATENT DOCUMENTS

| | | | | |
|---|---|---|---|---|
| 4,804,324 | A | 2/1989 | Yoshinaga | |
| 4,886,447 | A * | 12/1989 | Goss | F23D 14/38 239/432 |
| 5,374,185 | A | 12/1994 | Coulcher, Jr. et al. | |
| 5,997,045 | A * | 12/1999 | Bøe | F16L 39/00 285/119 |
| 6,116,658 | A * | 9/2000 | Bohlen | F16L 19/005 285/330 |
| 7,434,848 | B2 * | 10/2008 | Boyd | E21B 17/04 285/330 |
| 7,661,474 | B2 * | 2/2010 | Campbell | E21B 17/042 166/242.6 |
| 7,887,098 | B2 * | 2/2011 | Aas | F16L 15/08 285/391 |
| 9,133,968 | B2 * | 9/2015 | Elrick | E21B 17/046 |
| 9,879,856 | B2 * | 1/2018 | Tsai | F23D 14/28 |
| 2003/0127857 | A1 * | 7/2003 | Boyd | F16L 19/0237 285/330 |
| 2004/0048215 | A1 * | 3/2004 | Wong | F23D 14/38 431/344 |
| 2005/0022999 | A1 * | 2/2005 | Hughes | E21B 17/028 166/380 |
| 2006/0151997 | A1 * | 7/2006 | Sayers | F16L 41/06 285/197 |
| 2007/0284353 | A1 * | 12/2007 | Laymon | B23K 9/293 219/137.31 |
| 2008/0160471 | A1 * | 7/2008 | Lin | F23D 14/28 431/344 |
| 2011/0053103 | A1 * | 3/2011 | Burdsall | F23D 14/465 431/254 |
| 2011/0198320 | A1 * | 8/2011 | Mather | B23K 9/013 219/121.48 |
| 2016/0138738 | A1 * | 5/2016 | Crompton | B21D 39/048 285/345 |

FOREIGN PATENT DOCUMENTS

| | | | |
|---|---|---|---|
| CN | 203349273 | U | 12/2013 |
| TW | M357573 | U | 5/2009 |
| TW | I405937 | B | 8/2013 |
| TW | M462347 | U | 9/2013 |

* cited by examiner

GAS TORCH HEAD INCLUDING BURNER TUBE THEREOF BEING REPLACEABLE

BACKGROUND OF THE INVENTION

1. Field of the Invention

The present invention relates to a gas torch head and, particularly, to a gas torch head including a burner tube thereof being replaceable.

2. Description of the Related Art

TW Patent No. 1405937 shows a combination of a gas torch head and a gas canister. The gas torch head is in fluid communication with the gas canister. Gas from the gas canister can be ignited by the gas torch head. The gas being ignited produces a flame. The flame is discharged from a burner tube. The burner tube can not be disengaged from the gas torch head. Consequently, the burner tube is not replaceable.

The present invention is, therefore, intended to obviate or at least alleviate the problems encountered in the prior art.

SUMMARY OF THE INVENTION

According to the present invention, a gas torch head is adapted to connect to a fuel reservoir and to ignite fuel exited from the fuel reservoir. The gas torch head has a main body and a burner tube. The main body includes a channel extending therein and having an inlet port at a first end and an outlet port at a second end, respectively. Fuel exited from the fuel reservoir is adapted to flow into the channel through the inlet port. The burner tube is releasably inserted into the main body. The burner tube is connected to the outlet port of the channel so that fuel exited from the channel is adapted to flow into the burner tube. A flame is caused as a result of fuel combustion by the gas torch head and is generated outside the burner tube.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
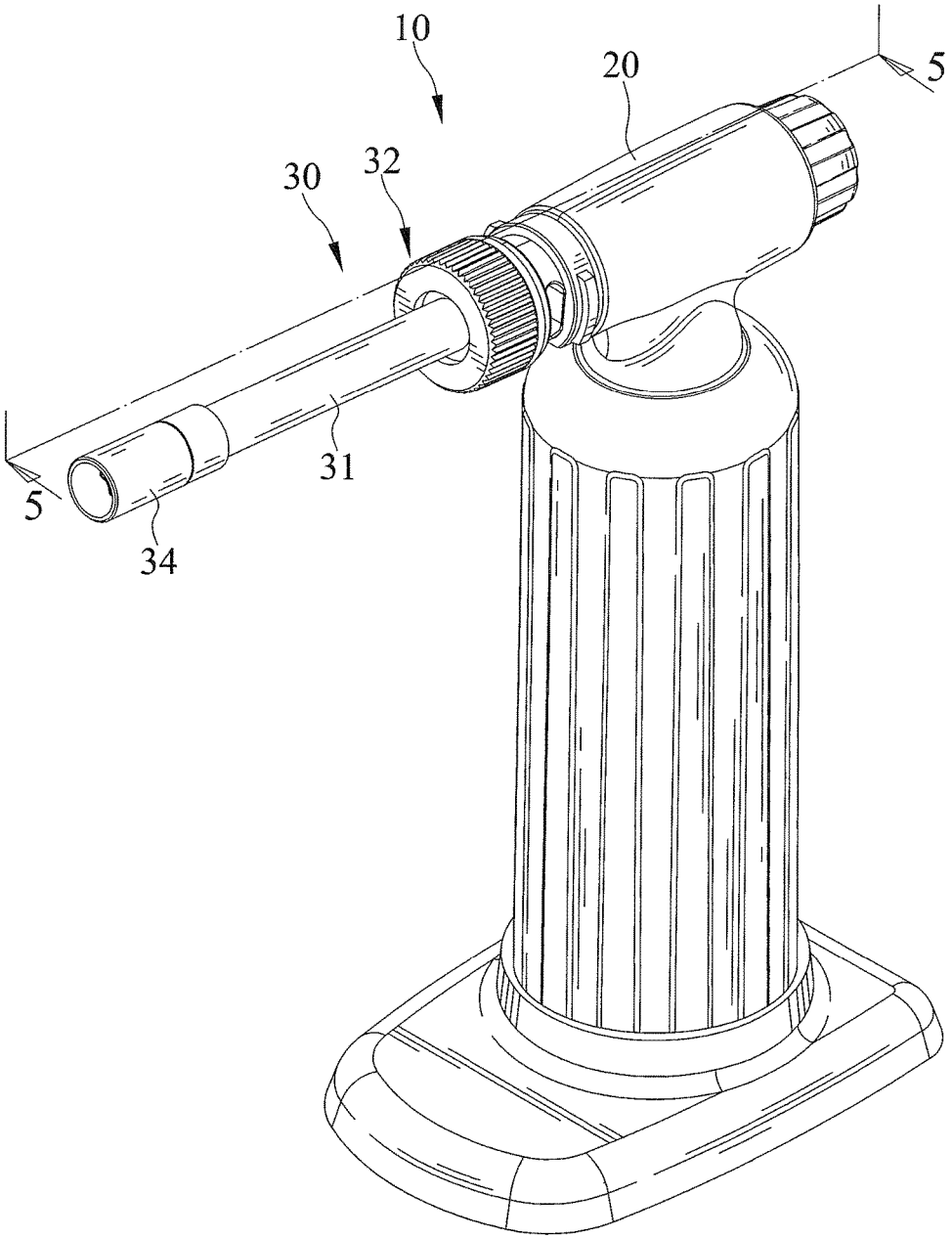
FIG. 1 is a perspective view of a gas torch including a gas torch head in accordance with a first embodiment of the present invention.
Figure 2:
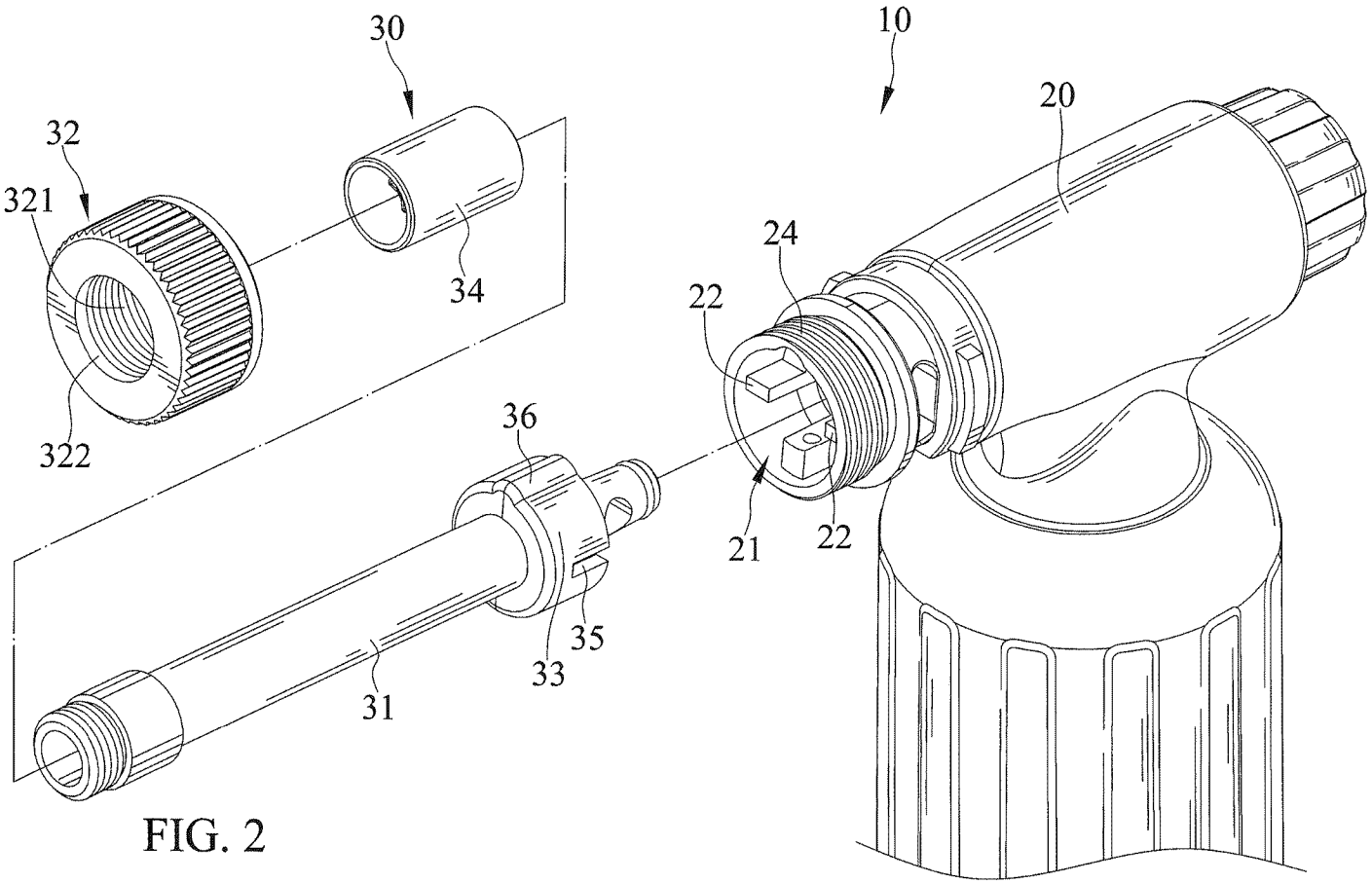
FIG. 2 is an exploded, perspective view of the gas torch head of the first embodiment.
Figure 3:
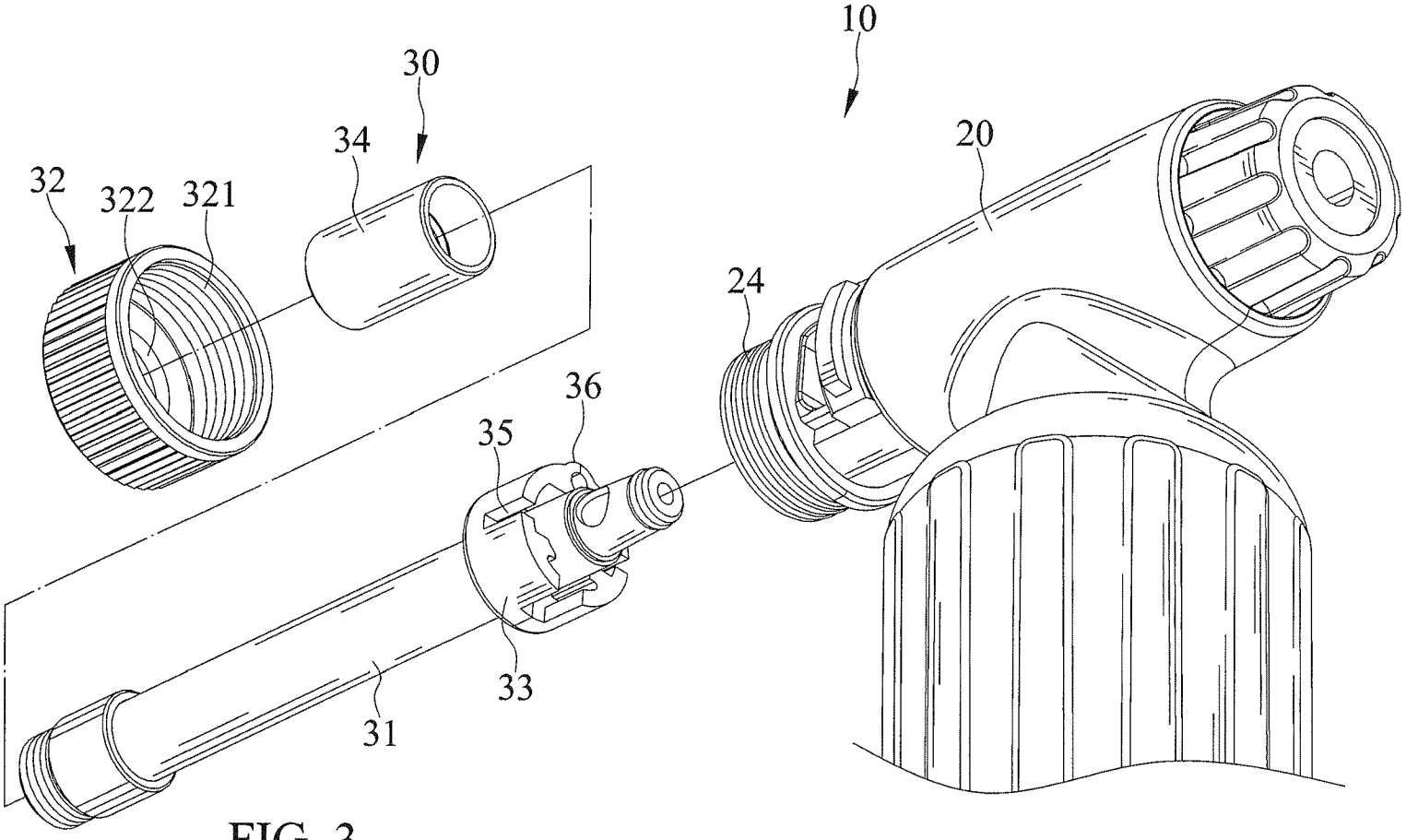
FIG. 3 is similar to FIG. 2, but viewed from a different angle.
Figure 4:
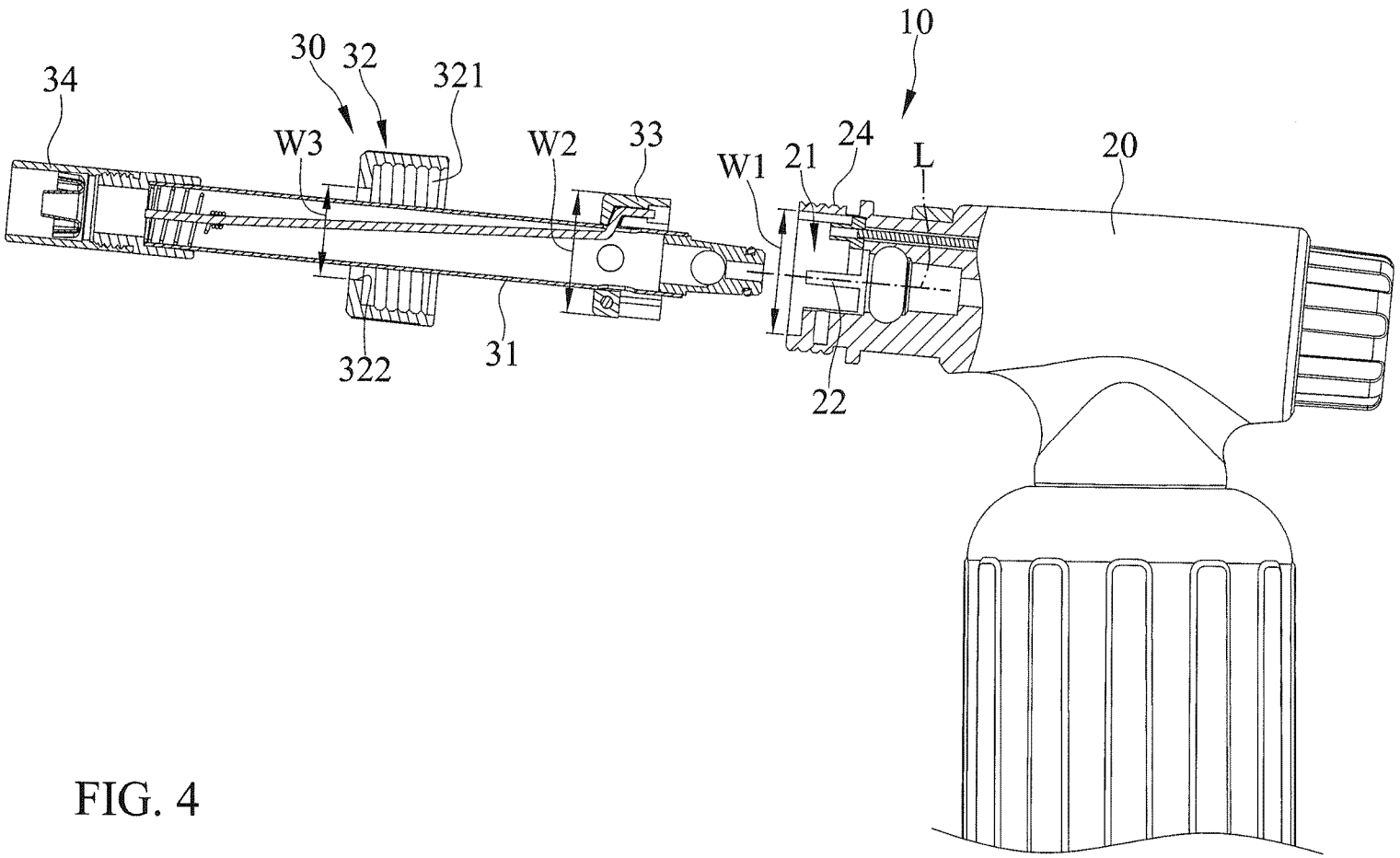
FIG. 4 is an exploded, cross-sectional view of the gas torch head of the first embodiment.
Figure 5:
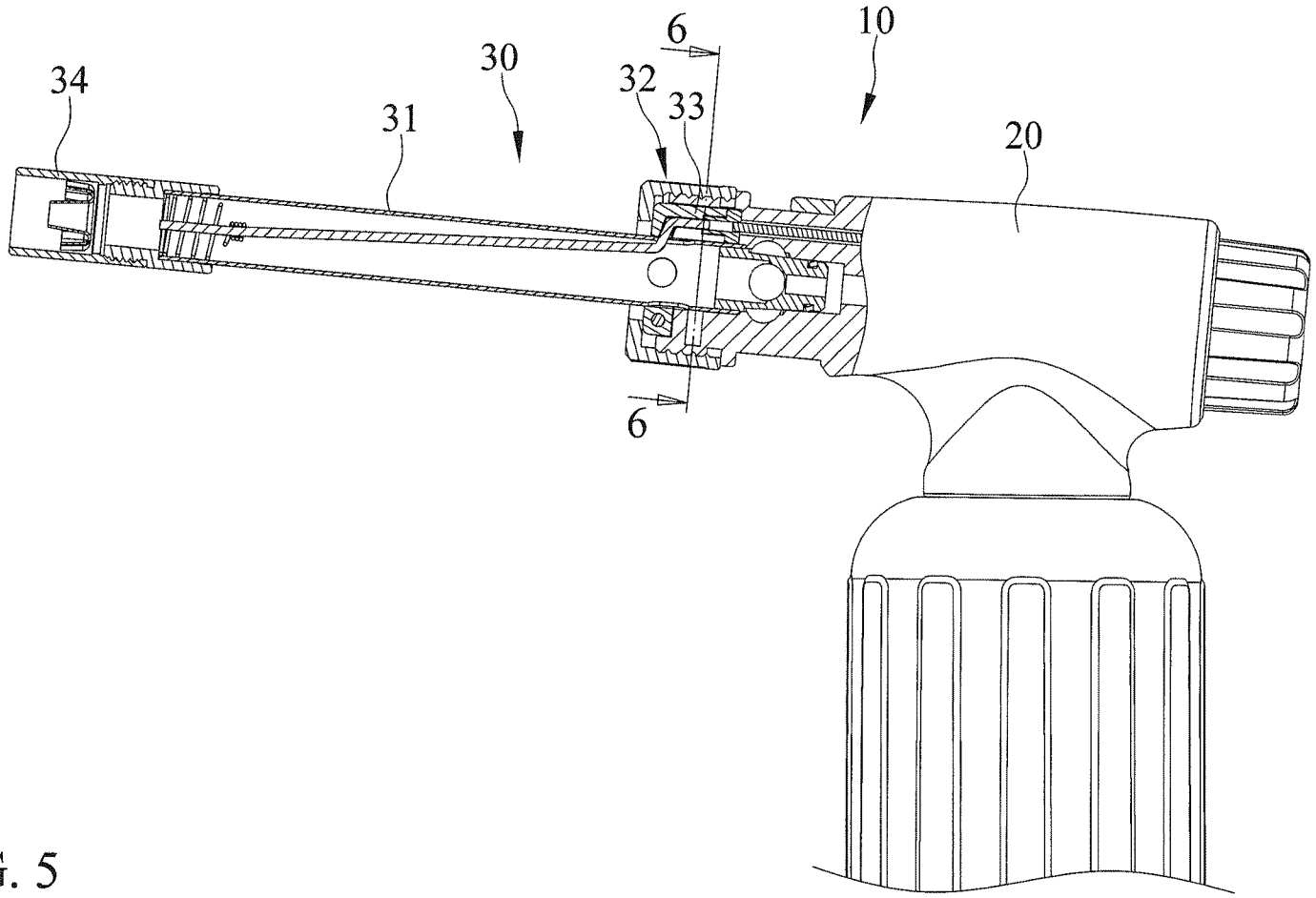
FIG. 5 is a cross-sectional view taken along line 5-5 of FIG. 1.
Figure 6:
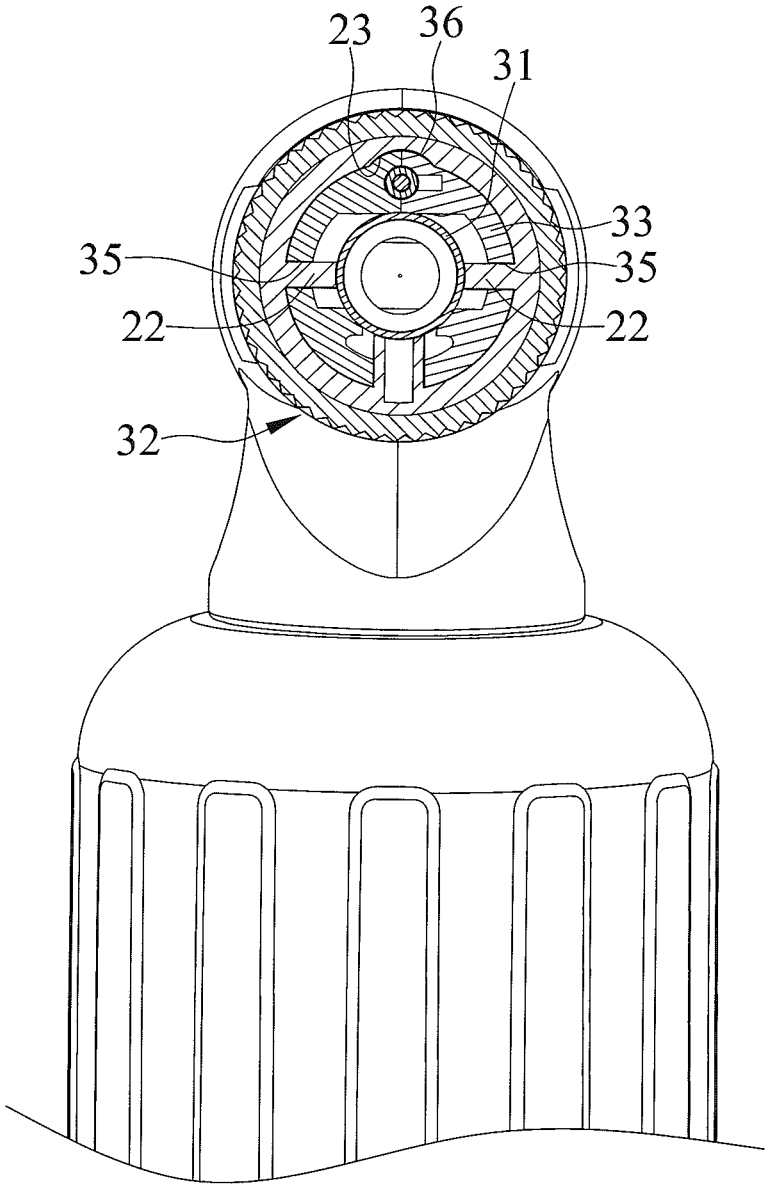
FIG. 6 is a cross-sectional view taken along line 6-6 of FIG. 5.
Figure 7:
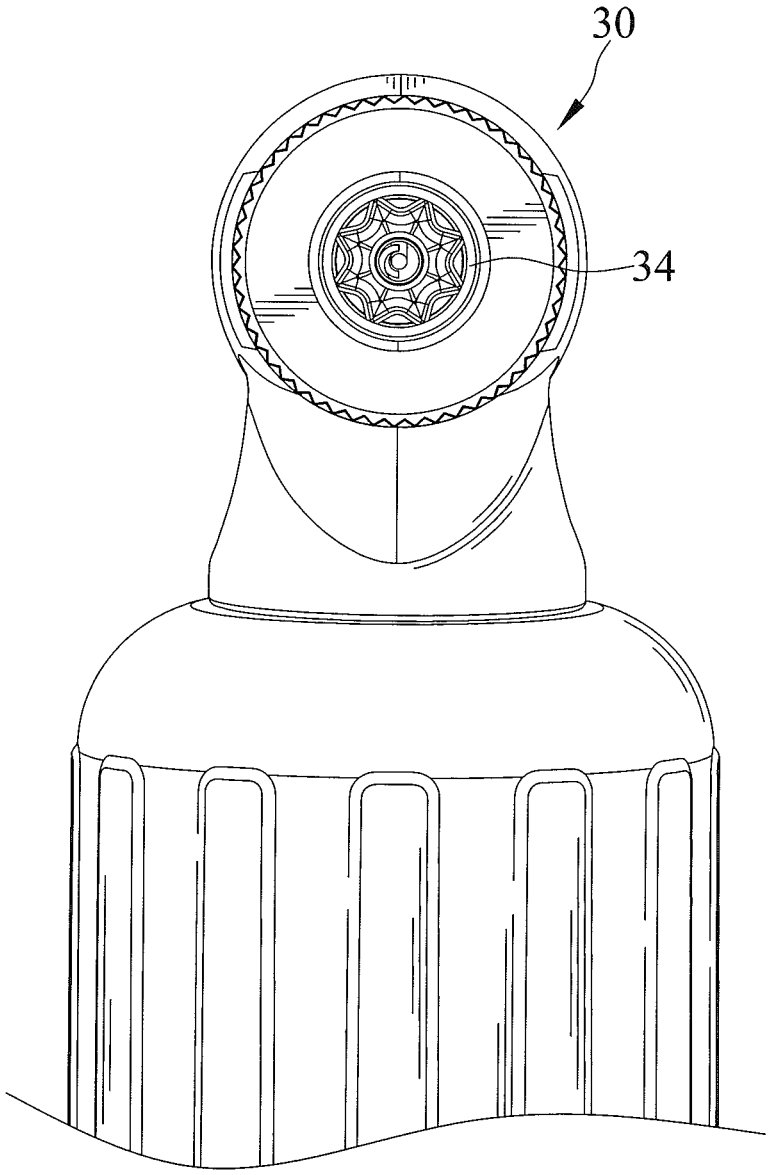
FIG. 7 is a side view of the gas torch head of the first embodiment.
Figure 8:
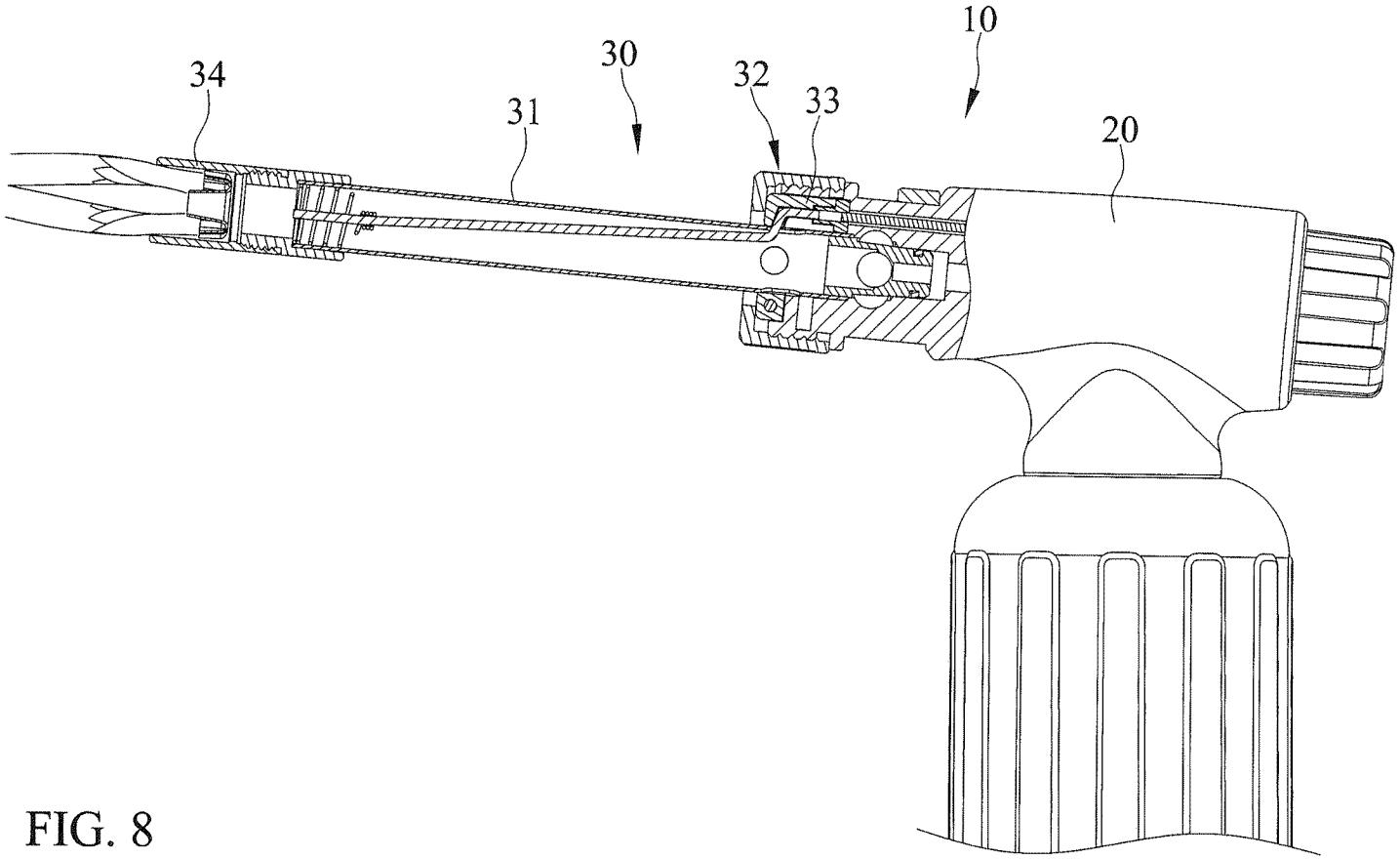
FIG. 8 is a cross-sectional view illustrating a flame discharged from the gas torch head of the first embodiment.

FIGS. 1 through 8 show a torch including a gas torch head 10 in accordance with a first embodiment of the present invention. The gas torch head 10 is adapted to connect to a fuel reservoir and to ignite fuel exited from the fuel reservoir. The gas torch head 10 includes a main body 20 and a burner tube 30.

The main body 20 includes a channel 21 extending therein and having an inlet port at a first end and an outlet port at a second end, respectively. Fuel exited from the fuel reservoir is adapted to flow into the channel 21 through the inlet port.

The burner tube 30 is releasably inserted into the main body 20 and connected to the outlet port of the channel 21 so that fuel exited from the channel 21 is adapted to flow into the burner tube 30. A flame caused as a result of fuel combustion by the gas torch head 10 is generated outside the burner tube 30.

The gas torch head 10 also includes a retainer 32 configured to selectively secure the main body 20 and the burner tube 30 together. The retainer 32 is mounted on one of the main body 20 and the burner tube 30 and is movable between a first position engaging with the other of the main body 20 and the burner tube 30 and a second position disengaging from the other of the main body 20 and the burner tube 30, respectively. The retainer 32 is mounted on the burner tube 30. The retainer 32 in the first position is releasably engaged with a joining structure 24 of the main body 20. The retainer 32 and the main body 20 are in thread engagement, with the joining structure 24 including outer threads at the end, and with the retainer 32 having an inner periphery thereof forming inner threads. The inner threads are defined as an engaging structure 321.

The channel 21 has a retaining structure 22 configured for inhibiting the burner tube 30 from movement, with the retaining structure 22 engaging with a seat 33 of the burner tube 30. The outlet port of the channel 21 includes an opening at an end of the main body 20. The opening has a maximum diameter defining a first diameter W1. The seat 33 has a maximum diameter defining a second diameter W2, with the second diameter W2 being smaller than the first diameter W1. The retainer 32 is in a form of a sleeve and includes a wall with an opening at a first end having a minimum diameter defining a third diameter W3, with the third diameter W3 being smaller than the second diameter W2. The retaining structure 22 includes at least one first protrusion, and an outer periphery of the seat 33 includes a first recess 35 with which the at least one protrusion engages. The at least one first protrusion extends radially between the channel 21 and the seat 33 in a direction parallel to a longitudinal direction L of the channel 21. The at least one first protrusion includes a plurality of first protrusions arranged circumferentially. The first recess 35 extends through an inner periphery of the seat 33. The at least one first protrusion and the first recess 35 have corresponding shapes. The at least one first protrusion has a rectangular contour. The seat 33 includes at least one second protrusion 36, and a periphery of the channel 21 includes a second recess 23 with which the at least one second protrusion 36 engages. The at least one second protrusion 36 extends radially between the channel 21 and the seat 33 in a direction parallel to a longitudinal direction L of the channel 21. The at least one second protrusion 36 and the second recess 23 are arranged circumferentially. The at least one second protrusion and the second recess 23 have corresponding shapes. The at least one first protrusion has a convex contour. The retaining structure 22 inhibits the burner tube 30 from rotating relative to the main body 20.

The burner tube 30 has a tubular body 31. The tubular body 31 has a hollow extending therethrough and forming a first hole at a first end and a second hole at a second end, respectively. The tubular body 31 has a maximum diameter being smaller than the third diameter W3. The burner tube 30 has a maximum diameter defining the second diameter W2 of the seat 33. As set forth, the maximum diameter of the tubular body 31 is smaller than the third diameter W3. Therefore, the tubular body 31 is adapted to be inserted through the retainer 32. However, the seat 33 can not be inserted through the retainer 32. The seat 33 will be obstructed by the wall at the first end of the retainer 32. The wall at the first end of the retainer 32 defines an obstructing side 322. The burner tube 30 inserted into the main body 20 has a first end received in the channel 21. The burner tube 30 has a second end. The tubular body 31 has a longitudinal length extending from the first end to the second end of the burner tube 30 axially.

The burner tube 30 includes a tip 34 releasably engaged therewith. The tip 34 and the tubular body 31 are in thread engagement. The tip 34 is engaged with the second end of the burner tube 30 and in fluid communication with the second hole. The tip 34 is configured for changing the shape of a flame as a result of fuel combustion by the gas torch head 10. The tip 34 is in a form of a sleeve and includes a plurality of holes disposed in an arrangement. The holes are configured as flame holes. The tip 34 has a star-shaped out port.

Figure 9:
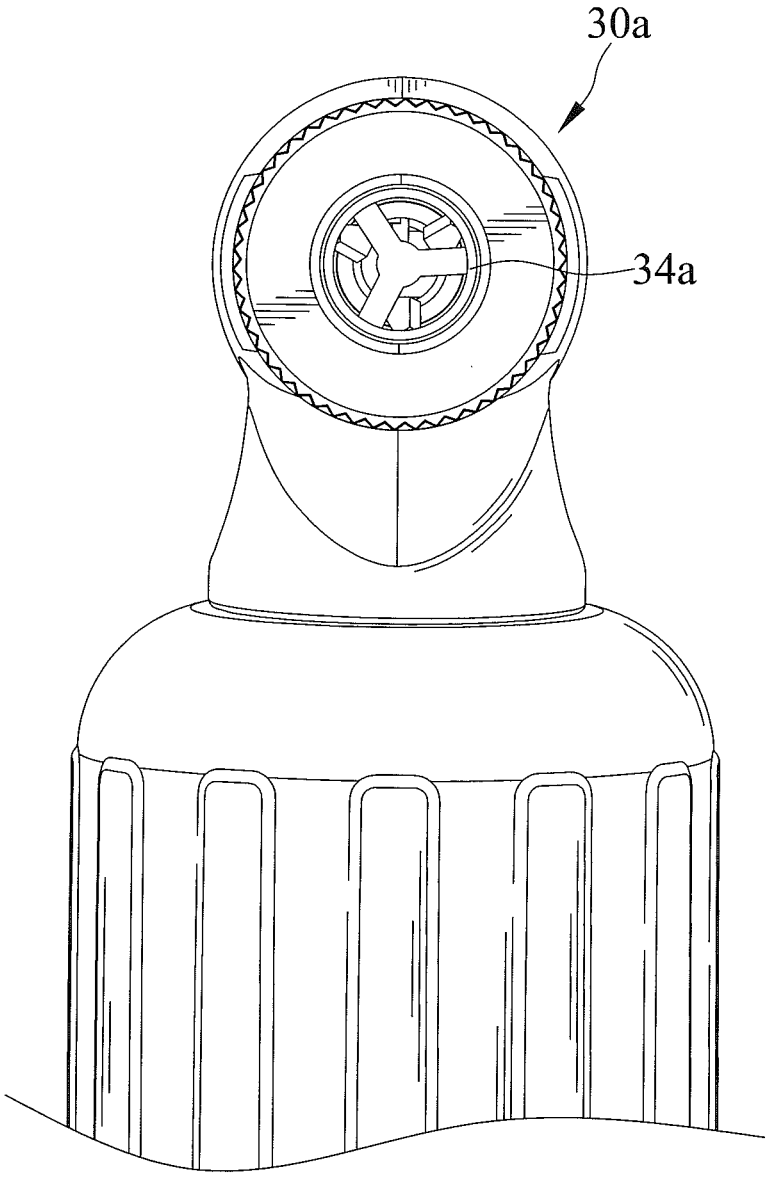
FIG. 9 is a partial, side view of a gas torch including a gas torch head in accordance with a second embodiment of the present invention.
Figure 10:
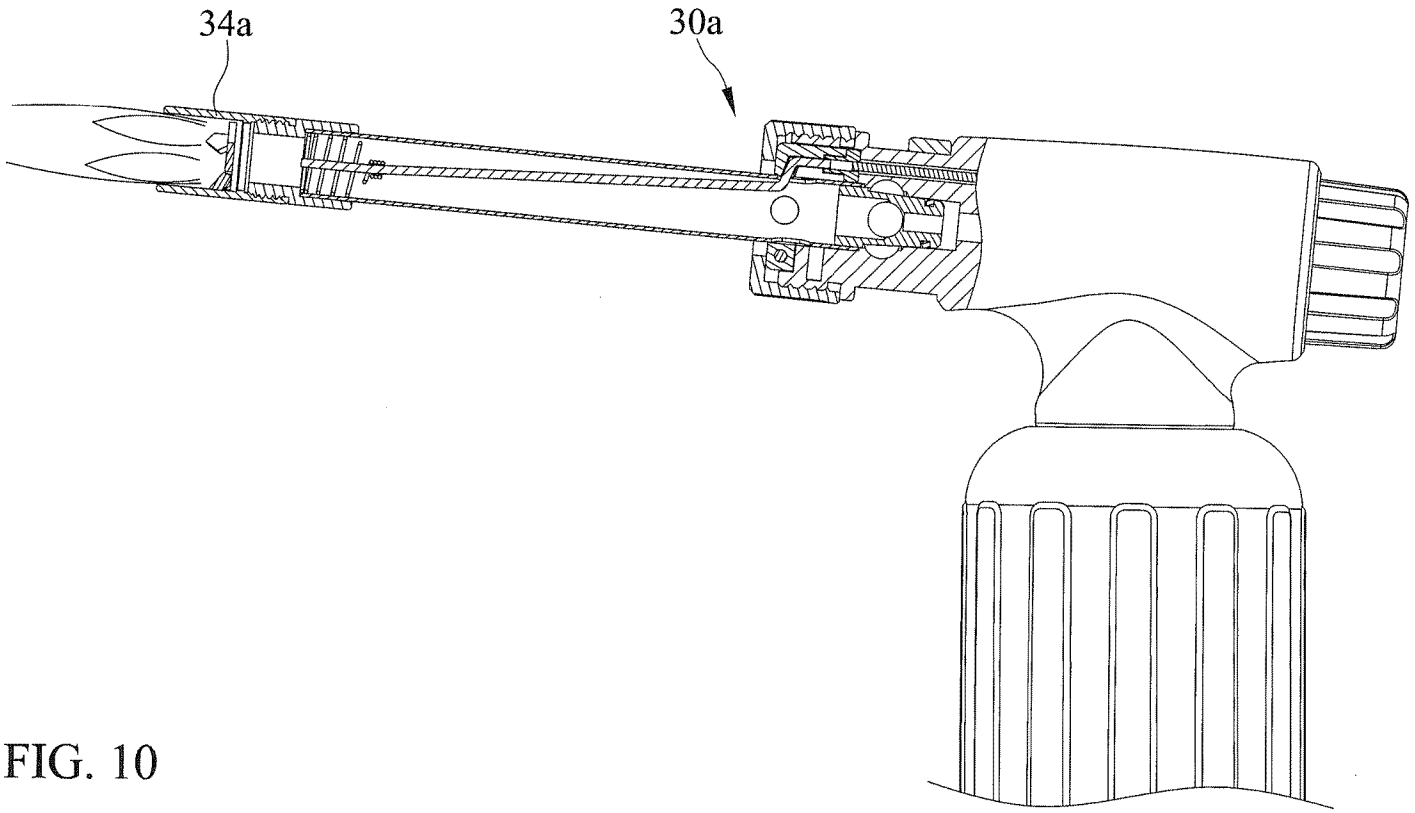
FIG. 10 is a cross-sectional view illustrating a flame discharged from the gas torch head of the second embodiment.

FIGS. 9 and 10 show a gas torch including a gas torch head in accordance with a second embodiment of the present invention, and the same numbers are used to correlate similar components of the first embodiment, but bearing a letter a. The second embodiment is similar to the first embodiment except that the burner tube 30 is substituted by a burner tube 30*a*. The burner tube 30*a* differentiates from the burner tube 30 in that it includes a tip 34*a* different from the tip 34. The tip 34*a* has a Y-shaped out port. Furthermore, flames disposed outside the burner tubes 30 and 30*a* have shapes different from each other.

Figure 11:
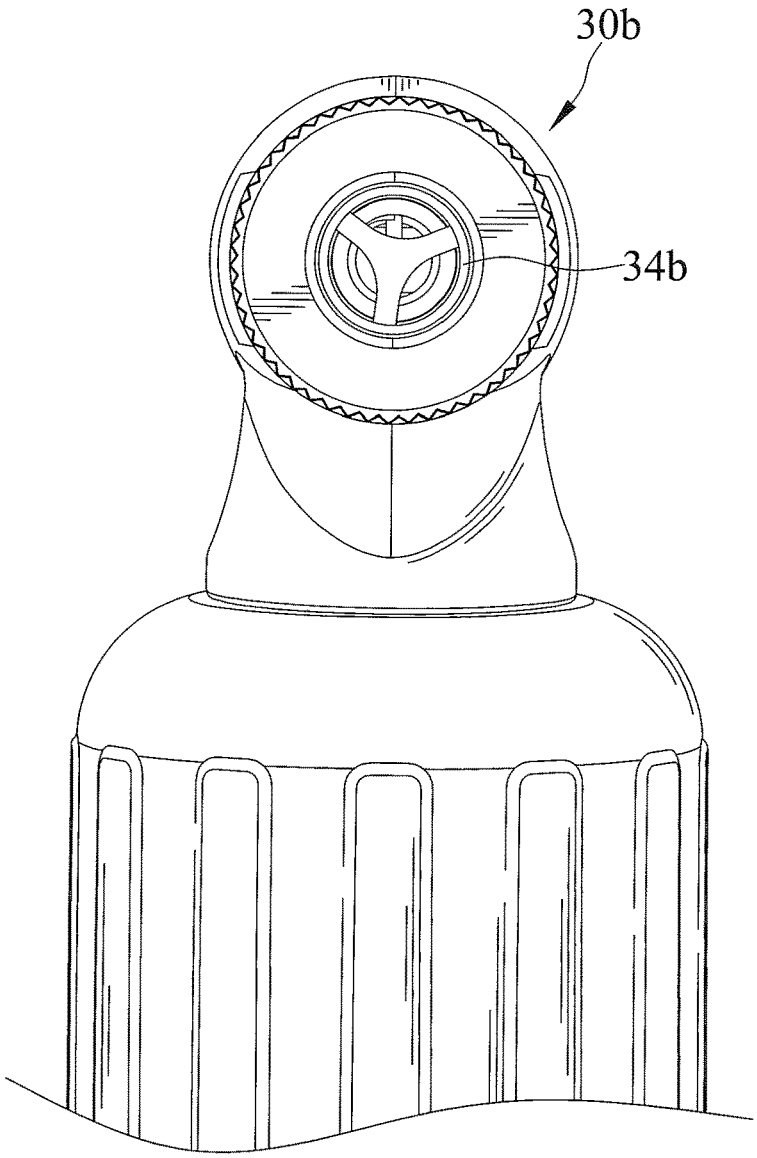
FIG. 11 is a partial, side view of a gas torch including a gas torch head in accordance with a third embodiment of the present invention.
Figure 12:
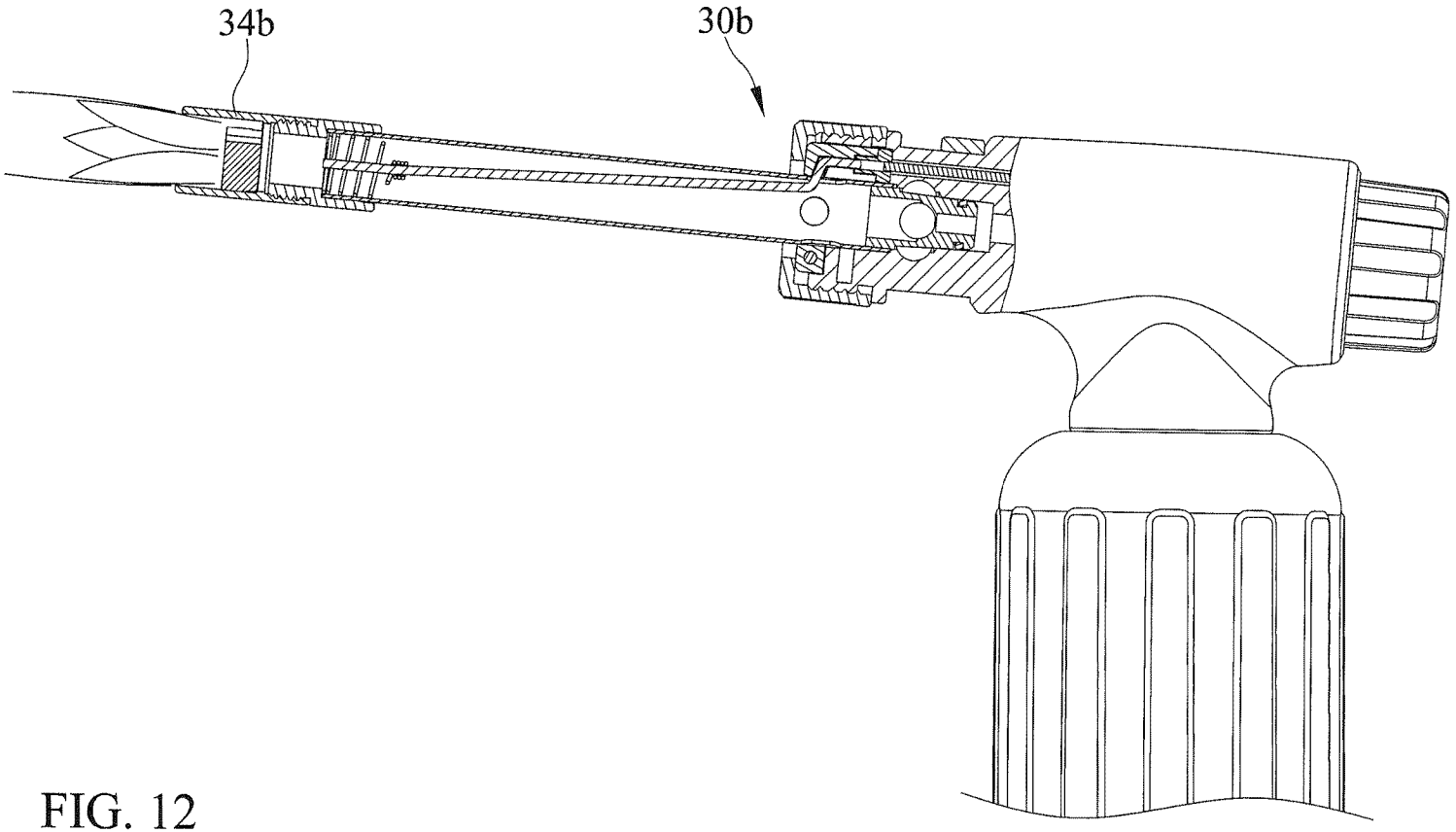
FIG. 12 is a cross-sectional view illustrating a flame discharged from the gas torch head of the third embodiment.

FIGS. 11 and 12 show a gas torch including a gas torch head in accordance with a third embodiment of the present invention, and the same numbers are used to correlate similar components of the first embodiment, but bearing a letter b. The third embodiment is similar to the first embodiment except that the burner tube 30 is substituted by a burner tube 30*b*. The burner tube 30*b* differentiates from the burner tube 30 in that it includes a gas tip 34*b* different from the tip 34. The gas tip 34*b* has an out port including a Y-shaped structure and at least one guiding member disposed between two legs of the Y-shaped structure. Furthermore, flames disposed outside the burner tubes 30 and 30*b* have shapes different from each other.

In view of the forgoing, the first, second third embodiments are similar to one another except the burner tubes 30, 30*a*, and 30*b*. The burner tubes 30, 30*a*, and 30*b* are releasably inserted into the main body 20 and connected to the outlet port of the channel 21. Furthermore, flames generated outside the burner tubes 30, 30*a*, and 30*b* are of different shapes.

The foregoing is merely illustrative of the principles of this invention, and various modifications can be made by those skilled in the art without departing from the scope and spirit of the invention.

What is claimed is:

1. A gas torch head adapted to connect to a fuel reservoir and to ignite fuel exited from the fuel reservoir comprising:

a main body including a channel extending therein and having an inlet port at a first end and an outlet port at a second end respectively, wherein fuel exited from the fuel reservoir is adapted to flow into the channel through the inlet port;

a burner tube releasably inserted into the main body and connected to the outlet port of the channel so that fuel exited from the channel is adapted to flow into the burner tube, wherein a flame caused as a result of fuel combustion by the gas torch head is generated outside the burner tube; and a retainer configured to selectively secure the main body and the burner tube together, wherein the retainer is mounted on one of the main body and the burner tube and is movable between a first position engaging with the other of the main body and the burner tube and a second position disengaging from the other of the main body and the burner tube, respectively, wherein the channel has a retaining structure configured for inhibiting the burner tube from movement, with the retaining structure engaging with a seat of the burner tube, wherein the outlet port of the channel includes an opening at an end of the main body, wherein the opening has a maximum diameter defining a first diameter, wherein the seat has a maximum diameter defining a second diameter, with the second diameter being smaller than the first diameter, wherein the retainer is in a form of a sleeve and includes a wall with an opening at a first end having a minimum diameter defining a third diameter, with the third diameter being smaller than the second diameter.

2. The gas torch head as claimed in claim 1, wherein the burner tube has a tubular body, wherein the tubular body has a hollow extending therethrough and forming a first hole at a first end and a second hole at a second end respectively, and wherein the tubular body has a maximum diameter being smaller than the third diameter.

3. The gas torch head as claimed in claim 2, wherein the retainer is mounted on the burner tube, and wherein the retainer in the first position is releasably engaged with a joining structure of the main body.

4. The gas torch head as claimed in claim 2, wherein the burner tube includes a tip releasably engaged therewith, wherein the tip is engaged with the second end of the burner tube and in fluid communication with the second hole, and wherein the tip is configured for changing a shape of the flame as a result of fuel combustion by the gas torch head.

5. The gas torch head as claimed in claim 4, wherein the tip is in a form of a sleeve and includes a plurality of holes disposed in an arrangement, and wherein the plurality of holes is configured as flame holes.

6. The gas torch head as claimed in claim 1, wherein the retainer is mounted on the burner tube, and wherein the retainer in the first position is releasably engaged with joining structure of the main body.

7. The gas torch head as claimed in claim 6, wherein the retainer and the main body are in thread engagement, with the joining structure including outer threads at the end, and with the retainer having an inner periphery thereof forming inner threads.

8. The gas torch head as claimed in claim 1, wherein the retaining structure includes at least one first protrusion, wherein an outer periphery of the seat includes a first recess with which the at least one protrusion engages, and wherein the at least one first protrusion extends radially between the channel and the seat in a direction parallel to a longitudinal direction of the channel.

9. The gas torch head as claimed in claim 8, wherein the at least one first protrusion includes a plurality of first protrusions arranged circumferentially.

10. The gas torch head as claimed in claim 8, wherein the seat includes at least one second protrusion, wherein a periphery of the channel includes a second recess with which the at least one second protrusion engages, and wherein the at least one second protrusion extends radially between the channel and the seat in a direction parallel to a longitudinal direction of the channel.

11. The gas torch head as claimed in claim 10, wherein the at least one first protrusion includes a plurality of first protrusions arranged circumferentially, and wherein the at least one second protrusion and the second recess are arranged circumferentially.

* * * * *